US007243588B2

(12) United States Patent
Beal

(10) Patent No.: US 7,243,588 B2
(45) Date of Patent: Jul. 17, 2007

(54) POWER-BASED CORE FOR AMMUNITION PROJECTIVE

(75) Inventor: Harold F. Beal, Rockford, TN (US)

(73) Assignee: Doris Nebel Beal Inter Vivos Patent Trust, Rockwood, TN (US)

( * ) Notice: Subject to any disclaimer, the term of this patent is extended or adjusted under 35 U.S.C. 154(b) by 0 days.

(21) Appl. No.: 10/995,669

(22) Filed: Nov. 23, 2004

(65) Prior Publication Data

US 2007/0131132 A1 Jun. 14, 2007

Related U.S. Application Data

(63) Continuation-in-part of application No. 10/145,927, filed on May 15, 2002, now Pat. No. 6,840,149, which is a continuation-in-part of application No. 10/135,248, filed on Apr. 30, 2002, now Pat. No. 6,581,523.

(60) Provisional application No. 60/291,397, filed on May 15, 2001.

(51) Int. Cl.
*F42B 30/02* (2006.01)

(52) U.S. Cl. ..... 86/55; 102/517

(58) Field of Classification Search ..... 102/519, 102/517

See application file for complete search history.

(56) References Cited

U.S. PATENT DOCUMENTS

| | | | | |
|---|---|---|---|---|
| 2,393,648 | A | 1/1946 | Martin | |
| 4,498,395 | A | 2/1985 | Kock et al. | |
| 4,665,828 | A | 5/1987 | Auer | |
| 4,949,645 | A | 8/1990 | Hayward et al. | |
| 5,189,252 | A | 2/1993 | Huffman et al. | |
| 5,279,787 | A | 1/1994 | Oltrogge | |
| 5,399,187 | A * | 3/1995 | Mravic et al. | 75/228 |
| 5,440,995 | A | 8/1995 | Levitt | |
| 5,540,749 | A | 7/1996 | Li et al. | |
| 5,763,819 | A | 6/1998 | Huffman | |
| 5,789,698 | A | 8/1998 | Beal | |
| 5,847,313 | A * | 12/1998 | Beal | 102/516 |
| 5,894,644 | A | 4/1999 | Mravic | |
| 5,963,776 | A | 10/1999 | Lowden et al. | |
| 6,074,454 | A | 6/2000 | Abrams et al. | |
| 6,371,029 | B1 | 4/2002 | Beal | |
| 6,447,715 | B1 | 9/2002 | Amick | |
| 6,536,352 | B1 | 3/2003 | Nadkarni et al. | |
| 6,613,165 | B1 | 9/2003 | Alexander | |
| 6,629,485 | B2 * | 10/2003 | Vaughn et al. | 86/55 |
| 2002/0178963 | A1 | 12/2002 | Halverson | |
| 2002/0178964 | A1 | 12/2002 | Beal | |

FOREIGN PATENT DOCUMENTS

| | | | |
|---|---|---|---|
| DE | 3226648 | A1 | 1/1984 |

* cited by examiner

*Primary Examiner*—Michael J. Carone
*Assistant Examiner*—Gabriel J. Klein
(74) *Attorney, Agent, or Firm*—Pitts & Brittian, P.C.

(57) ABSTRACT

A powder-based core having an outboard end, for a gun ammunition projectile, comprising a compressed quantity of a first powdered metal having a first melting point and a first density, and a second powdered metal having a melting point lower than the melting point of said first metal and a second density which is less than the density of said first metal, and a quantity of said second metal in solid form integrally formed with said outboard end of said core. A projectile formed from the core is disclosed.

8 Claims, 6 Drawing Sheets

POWER-BASED CORE FOR AMMUNITION PROJECTIVE

CROSS REFERENCE TO RELATED APPLICATIONS

This application is a continuation-in-part application of Ser. No. 10/145,927, filed May 15, 2002 now U.S. Pat. No. 6,840,149, entitled: IN-SITU FORMATION OF CAP FOR AMMUNITION PROJECTILE, which application is a non-provisional application claiming priority on Provisional application Ser. No. 60/291,397, filed May 15, 2001, entitled: METHOD FOR THE FORMATION OF A SOLID METAL CAP EMPLOYING HEATING OF A CORE IN A JACKET AND PRODUCT, and which is a continuation in part of application Ser. No. 10/135,248, filed Apr. 30, 2002 now U.S. Pat. No. 6,581,523, entitled: POWDER-BASED DISC HAVING SOLID OUTER SKIN FOR USE IN A MULTI-COMPONENT AMMUNITION PROJECTILE, all of the aforesaid related applications being incorporated herein in their respective entireties by reference and upon which priority is claimed.

STATEMENT REGARDING FEDERALLY SPONSORED RESEARCH OR DEVELOPMENT

Not Applicable

FIELD OF INVENTION

This invention relates to gun ammunition, and specifically to gun ammunition in which a round of the ammunition includes a casing which houses gunpowder and a projectile. More specifically, the present invention relates to projectiles for gun ammunition.

BACKGROUND OF INVENTION

Of relatively recent vintage is a gun ammunition projectile which is fabricated from two or more metal powders. In one embodiment, the metal powders are die-pressed into an elongated symmetrical generally cylindrical geometry. Such pressed compacts are at times referred to as "cores". In this embodiment, to form a projectile, a core is placed in a hollow cup-shaped metal jacket having one end thereof closed and its opposite end open for the receipt of the core. After the core has been placed in the jacket, it may be seated against the closed end of jacket. In one embodiment, which employs the cores of the prior art, a disc which has been formed externally of the projectile is introduced into the metal jacket on top of with a core. Thereafter, the jacket/core/disc sub assembly is die-formed to define an ogive on the open end of the jacket, and that end of the core adjacent the open end of the jacket. The formation of the ogive tends to partially crush that portion of the core which is involved in the formation of the ogive, generating unbonded and "semi-bonded" metal powder adjacent the leading end of the projectile. In those projectiles where the ogive end of the projectile is not fully closed, this unbonded or semi-bonded powder is free to escape from the jacket, or to move about within the ogive end of the jacket, during handling of a round of ammunition, while the round is in a gun, and/or after the round has been fired and the projectile is traveling to a target. In the course of this ogive forming operation, the disc is deformed and seals the open end of the jacket against the escape of powder particles from the jacket and is urged against the core to anchor the core and any "loose" powder particles against movement of the core or "loose" particles within and relative to the jacket.

In U.S. Pat. No. 5,789,698, the present inventor disclosed the use of a solid metal disc disposed within the jacket adjacent the exposed end of the core prior to formation of the ogive. As the ogive is formed, this disc is also deformed and urged toward the open end of the jacket where it defines a cap which seals the open end of the jacket to prevent the escape of metal powder from the ogive end of the projectile and/or to preclude migration of loose powder non-uniformly radially of the longitudinal axis (the spin axis) of the projectile.

SUMMARY OF THE INVENTION

Figure 1:
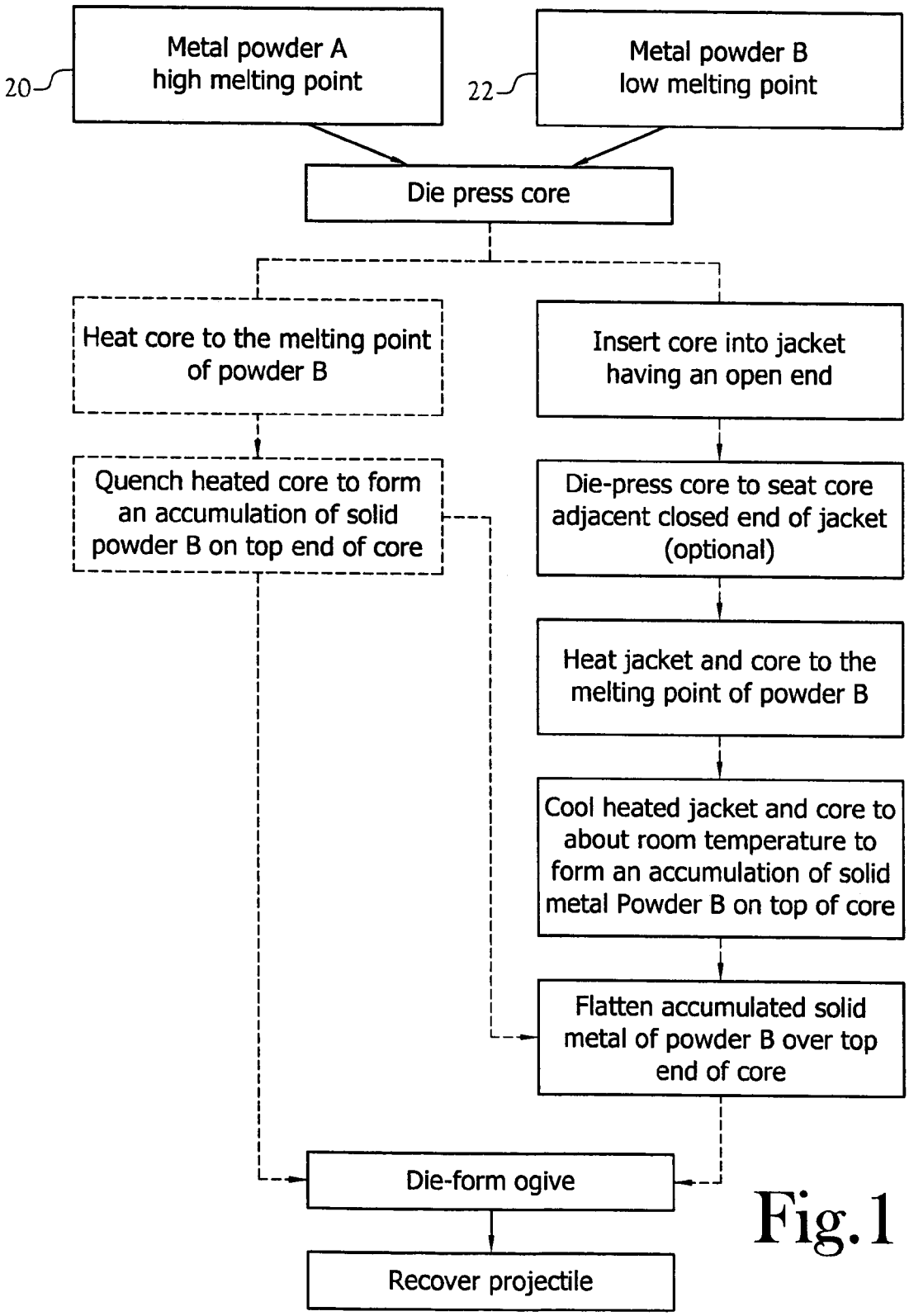
FIG. 1 is a schematic flow diagram of one embodiment of a method of making a core embodying various aspects of the present invention.

In accordance with one aspect of the present invention there is provided an elongated symmetrical, self-supporting metal powder-based core comprising at least a first powder of a metal having a first melting point and a first density, and a second powder of a metal having a melting point that is lower than the melting point of the first powder and a density which is less than the density of the first metal, e.g. tungsten and tin metal powders respectively. This core, standing alone or disposed within a metal jacket having a closed (inboard) end and an open (outboard) end, to define a jacket-core subassembly, and while disposed in a substantially vertical attitude, is heated to that temperature at which that one of the metal powders of the core which has the lower melting point will migrate (e.g., flow) within the core. This heat treatment has been found by the present inventor to cause a substantial portion of the lower melting point metal powder to migrate to the uppermost outboard end of the core where it accumulates in the form of a generally dome-shaped accumulation of solid metal (e.g. tin). Upon cooling of the core or the heated jacket-core subassembly, the molten metal accumulated on the outer surface of the outboard end of the core solidifies. It appears that the molten tin migrates via capillary action along tortuous pathways defined internally of the core by connecting interstices between adjacent ones of the non-molten tungsten particles. Such flow of the molten tin is further believed to be enhanced by expansion of gas(es) (e.g. air) that is contained in pockets also defined by interstices between tungsten and/or tin particles of the core.

The core with its accumulation of solid metal is thereafter placed in a die cavity and pressed employing a pressure applied axially along the longitudinal centerline of the core. This pressure flattens the accumulation of solid metal into a cap which covers essentially the entire outer surface of the outboard and of the core (whether the core is pressed alone or while disposed in a jacket). The cap is integrally formed with the top end of the core, including at least a mechanical bonding of the cap with underlying particles (particularly tungsten powder particles) of the core. For purposes of clarity in the present application, this flattened solid metal covering on the outboard end of the core is referred to, at times, as a "cap".

Still further, the movement of the molten tin particles toward the outer surface(s) of the core develops void interstices between adjacent ones of the tungsten particulates, thereby enhancing the frangibility of the core when it has been incorporated into a projectile and such projectile is fired and strikes a target.

Thereafter, an ogive is die-formed on the outboard end of the jacket-core-cap combination. In the course of forming the ogive, the cap is deformed into a generally cup-shaped (generally hollow hemispherical) geometry within the outboard end of the jacket. As desired, this cap may be caused to fully fill the outboard end of the jacket or it may be caused to fill less than all of the outboard end of the jacket, leaving a meplat cavity adjacent the open end of the jacket and distal of the core. In any event, the cap serves to retain any unbonded or semi-bonded powder particles or the core itself against their movement within the jacket and to prevent the escape of such particles from the jacket. In this embodiment, the hollow center of the deformed cap faces inwardly of the jacket and becomes filled with powder particles of the core.

DETAILED DESCRIPTION OF INVENTION

Figure 10:
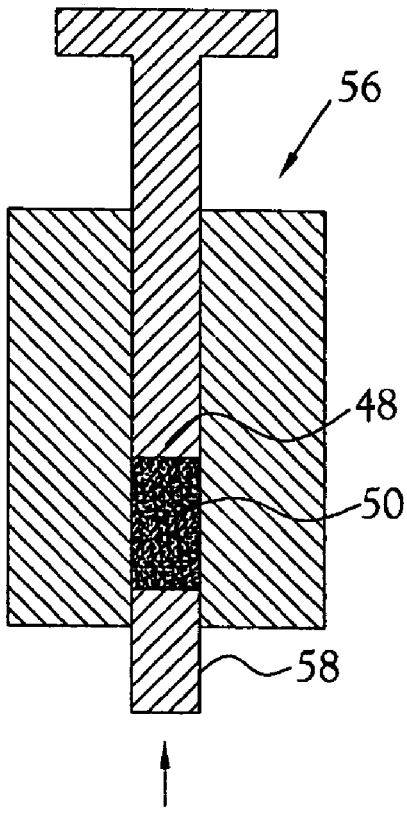
FIG. 10 is a representation, in section, of a subassembly for die-forming a core from a mixture of metal powder.
Figure 11:
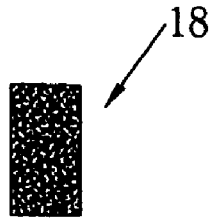
FIG. 11 is a side view of a pressed core formed employing the subassembly depicted in FIG. 8.
Figure 12:
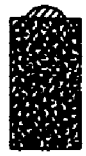
FIG. 12 is a representation of a heated and cooled core having an accumulation of solid metal on the top end thereof.
Figure 13:
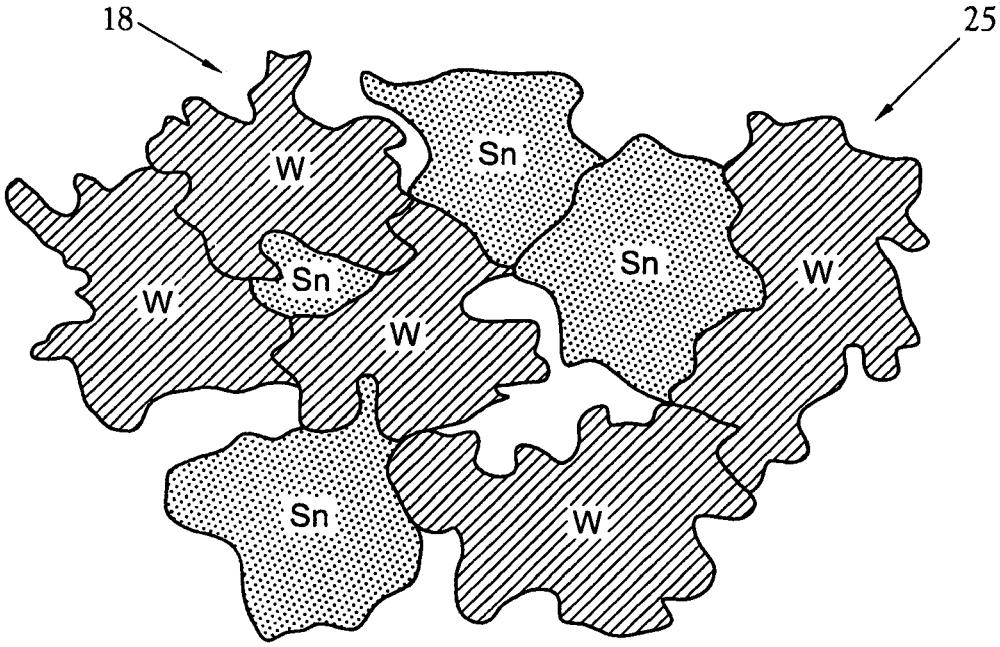
FIG. 13 is an exaggerated schematic representation of the powder particulates of a core formed by cold-pressing (room temperature) a mixture of tungsten and tin metal powders and depicting distribution of the powder particulates, including air pockets in the interstices between various ones of the powder particulates.

Referring to the several Figures, to form a projectile 52 in accordance with one embodiment of the present invention, a metal, e.g. brass or copper, jacket 12 having a closed (inboard) end 14 and an open (outboard) end 16 is provided with a core 18 which is seated against the inboard end of the jacket. The core of the present invention is formed from a mixture of at least two metal powders, such as tungsten metal powder 20 and tin metal powder 22 which has been mixed and then die-pressed (FIG. 10) into a self-supporting cylinder (core) 18 (FIG. 11). It will be noted that the melting point and density of the tungsten powder are each materially higher than the melting point and density of the tin powder and that both the tungsten powder and the tin powder are substantially uniformly mixed and dispersed throughout the core. A typical core so produced will include a minor portion of air-pockets AP (FIG. 13) defined between areas of non-contact of the tungsten (W) and tin (Sn) powder particles of the core, i.e. interstices between the powder particles of the pressed core. Typical bulk densities of a self-supporting core die-pressed at room temperature at between about 4,000 psi and about 12,000 psi may range considerably, but generally will be at least about 85% of the theoretical density of the combined tungsten and tin powders.

Figure 2:
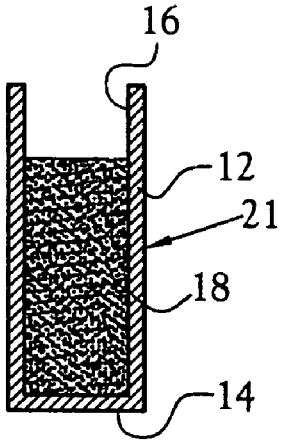
FIG. 2 is a representation, in section, of a pressed, unheated core disposed in an open-ended jacket.
Figure 3:
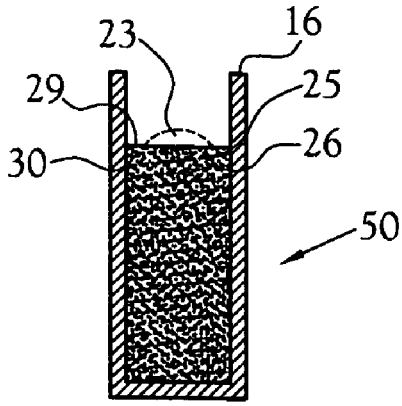
FIG. 3 is a representation, in section, of the metal jacket and core subassembly of FIG. 2 after heating of the core to a temperature approximately equal to the melting point of that metal powder of the core having the lower melting point, and depicting the accumulation of a solid metal on the outboard end of a heated core.

Referring to FIGS. 2 & 3 upon heating of the jacket-core subassembly 21 (prior to forming an ogive on the subassembly) in an oven 23 to a temperature at least as high as the temperature at which that one of the metals having the lower melting point of the multiple metals which comprise the core, the particles of such lower melting point metal become fluidized. This fluidized metal preferentially migrates along multi-directional paths radially outwardly and longitudinally upwardly from and along the center of the core. (see FIGS. 4 and 5)

It has been found by the present inventor that the migrating lower melting point metal, e.g. tin, initially accumulates on the outer surface 29 of the top end 25 of the core in the form of a dome 23 which most commonly is located substantially centrally of the outer surface 29 of the top end 26 of the core. Portions of the fluidized metal may also accumulate on the outer side surface of the core, but it is the accumulation on the outer top end of the core which is the essence of the present invention.

Specifically, the present inventor has discovered that through selection of the temperature to which the core is subjected, and the residence time of the core at such selected temperature, followed by air quenching or like cooling of the heated core sufficient to effect solidification of the accumulation of lower milting point metal powder and concomitant integration of the covering with underlying particles of the higher melting point metal, the lower melting point metal preferentially accumulates on the outboard end 25 of the core 18 in position for ready subsequent die-pressing of the core and its dome of accumulated solid metal to flatten the dome into a disc (cap) covering essentially the entire outer surface 29 of the top and of the core (see FIG. 3).

Figure 4:
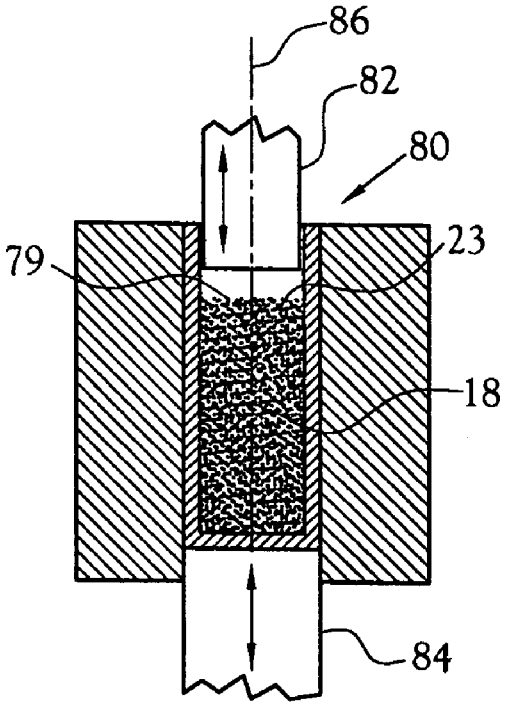
FIG. 4 depicts the die-forming of a thin solid cap on the top and of the core from the accumulation of solid metal on the top end of the core.
Figure 5:
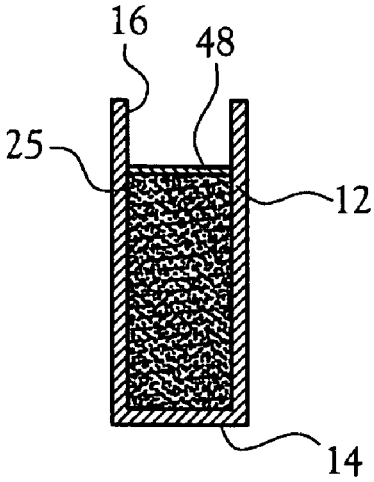
FIG. 5 depicts a core having a solid metal cap formed by the die depicted in FIG. 4.

In accordance with one aspect of the present invention, the thus heat-treated core disposed within the jacket is placed into the cavity 79 of a die 80 having first 82 and second 84 reciprocatable punches as seen in FIG. 4. Employing this die/punch device, pressure is applied axially along the longitudinal centerline 86 of the core element, whereupon the dome 23 is flattened into a flat cap 48 integrally formed with the top end of the core as depicted in FIG. 5. Whereas FIGS. 4 and 5 depict a core element disposed within a jacket, as desired, the core element may be heated without a jacket and thereafter die-pressed without the jacket, with essentially the same resultant flattening of the dome into a cap. In this latter event, the heated, cooled and die-pressed core may be loaded into a jacket.

Whereas this cap so formed is essentially a layer of solidified lower melting point metal, e.g. tin, there is little visually observable, without magnification, demarcation line between the solidified lower melting point metal and the particles of the higher melting point metal.

EXAMPLE I

In one embodiment of the present invention, a plurality of cores 18, each comprising a quantity of an admixture of 60%, by wt., tungsten metal powder and 40%, by wt, of tin powder, were formed by pressing measured quantities of the admixture in a die 56 having a substantially straight-sided cylindrical cavity 54 at room temperature into a self-supporting cylindrical compact (core) 18 (FIG. 11). These cores were thereafter placed on a glass support 27 in a common laboratory oven 23, each core being disposed upright on the support.

Thereupon, the oven door was closed and the temperature internally of the oven was increased from room temperature in steps. In a first step, the temperature within the oven was increased to about 230 degrees F. After about 2 minutes dwell time at 230 degrees F., the temperature within the oven was increased to about 235 degrees F. and held at this temperature of about 2 minutes. Thereupon the door to the oven was opened to room temperature to air quench and cool the heated cores to room temperature. Each core exiting the oven included a dome-shaped accumulation of solid tin metal on its top end.

Thereafter, each core was die-pressed to form a flat cap on the top end of the core. The cores so heat-treated and die-pressed, each exhibited a "shiny" top surface indicative of a solid tin cap 48 of the top surface of each core. Microscopic examination of sectioned ones of the cores indicated that the cap comprised solid tin metal which was integrally formed with underlying tungsten particles as depicted schematically in FIGS. 14 & 15.

EXAMPLE II

In a further embodiment of the present invention, a plurality of cores of the same composition as in Example I and formed as in Example I, were disposed in individual copper alloy (common ammunition brass) jackets 12, as depicted in FIG. 2 each jacket being of a cup-shape having a closed end 14 and an open end 16. The jacket/core subassemblies were heated in the oven 23 of Example I using the same temperature increase schedule except that there was provided a dwell time of 2½ minutes between each of the temperature levels of the schedule. Thereafter, the door of the oven was opened to room temperature whereupon the jacket/core subassemblies were air quenched and cooled to room temperature. As in Example I, the top surface of each core within its respective jacket included a dome-shaped accumulation of solid tin metal on its top end. Following die pressing of these cores in their jackets, to flatten the dome into a cap, each core exhibited a "shiny" solid metal tin cap 48 on the top surface of each core, substantially the same as in Example I.

EXAMPLE III

In a further embodiment of the present invention, a plurality of cores of the same composition as in Example I were disposed in individual copper alloy (common ammunition brass) jackets as in Example II. These jacket/core subassemblies were positioned upright on a glass support with the open ends of the jackets most upward. The jacket/cores subassemblies on the support were fully exposed to room temperature. Thereafter, the jacket/core subassemblies were rotated through a flame which produced a temperature of about 250 degrees F. and which was directed onto the jacket/core subassemblies for about 50 to 75 seconds until the color shading of the jacket darkened to a light brown coloration. At this junction, the flame was removed and the heated jacket/core subassemblies were air quenched and cooled by the ambient room temperature. The cores within the jackets each possessed a dome-shaped accumulation of solid tin metal on their respective top end. These domes were flattened into respective caps having an appearance as were the cores of Examples I and III.

Alternatively, other like jacket/core subassemblies were heated and subsequently quenched using a water sprayed onto the heated subassemblies. These subassemblies were die-pressed as in Example I, producing capped cores as in Example I.

EXAMPLE IV

In a still further embodiment of the present invention, a plurality of cores, without jackets, of the same composition as in Example I were positioned upright on a glass support. These cores on the support were fully exposed to room temperature. Thereafter, the cores were rotated through a flame which produced a temperature of about 250 degrees F. and which was directed onto the cores for about 50 to 75 seconds. At this junction, the flame was removed and the heated cores were air quenched and cooled by the ambient room temperature. Each core so heat-treated included a dome-shaped accumulation of solid tin metal on its top end. Die-pressing of the cores produced a flattened cap on each core as in Example I.

Other percentage combinations of tungsten and tin powders, e.g., ranging between about 95% and about 20%, by wt. tungsten powder and about 5% and 80%, by wt. of tin powder were pressed and heat treated as in Examples I –IV. Each of these percentage compositions of tungsten powder and tin powder, after heating and solidification of the tin, possesses a dome-shaped accumulation of solid tin metal on its top end and after being die-pressed, exhibited a like "shiny" cap on the top end surface of each of the cores, whether treated outside a jacket or within a jacket.

In the preparation of the cores, preferably, the tungsten powder and the tin powder of the admixture were each of predominately 325 mesh particle size. In the formation of the admixture of the tungsten and tin powders, the metal powders were blended in the presence of not more that 0.015%, by wt, of the total weight of the tungsten and tin powders, of non-metal matrix powder such as a micronized polyethylene powder having a density of less than about one. U.S. Pat. No. 6,551,376, the entirely of which is incorporated herein by reference, provides further guidance in the formation of powder-based compacts (cores) having enhanced uniformity of density distribution throughout each compact.

Figure 6:
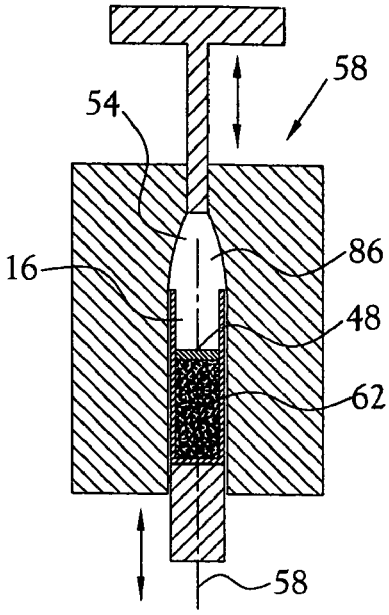
FIG. 6 depicts the die-pressing of an ogive on the outboard end of a jacket and core subassembly.
Figure 8:
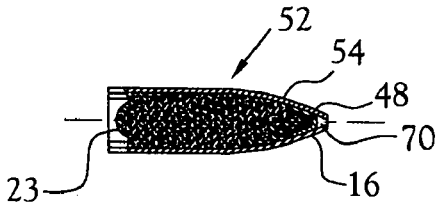
FIG. 8 depicts a completed projectile manufactured in accordance with the method of the present invention.

In accordance with one aspect of the present invention, the heat treated, cooled and subsequently die-pressed cores disposed in a metal jacket or cores heat treated outside a jacket and subsequently introduced into a jacket, were individually introduced into a die 58 having a cavity 60 which defined an ogive geometry 54. In each instance, the open end 16 of each jacket was disposed adjacent the ogive geometry forming portion of the die cavity. Within the die, each jacket/core subassembly 62 was subjected to axially applied pressure to deform the open end of the jacket and a portion of the top end of the core within the jacket inwardly toward the longitudinal centerline 86 of the jacket to define an ogive 54 on the end 16 of the jacket/core/cap subassembly and definition of a projectile 52 for firing from a weapon. This action resulted in some crushing of the top end of the powder-based core. However, it was found that the solid tin metal cap of the top end of the core also deformed along with the open end of the jacket, but without destruction of the solid continuity of the cap. (see FIGS. 6 and 8) Rather, the cap, when deformed in the ogive die cavity, continued to provide a solid covering over the top end (now partially crushed) powder-based core. This action resulted in the development of a solid metal seal extending generally laterally fully across a cross-section of the jacket within the area of the ogive. This seal substantially completely sealed off the core within the jacket from the ambient environment and precluded either the further dislodgement of powder particles from the top end of the core and the escape of any such dislodged, particles from the jacket during firing of the projectile from a weapon and the flight of the projectile to a target. As desired, the forming of the ogive may produce complete closure of the open end of the jacket or partial closing, leaving a meplat 70 in the end 16 of the jacket.

Figure 14:
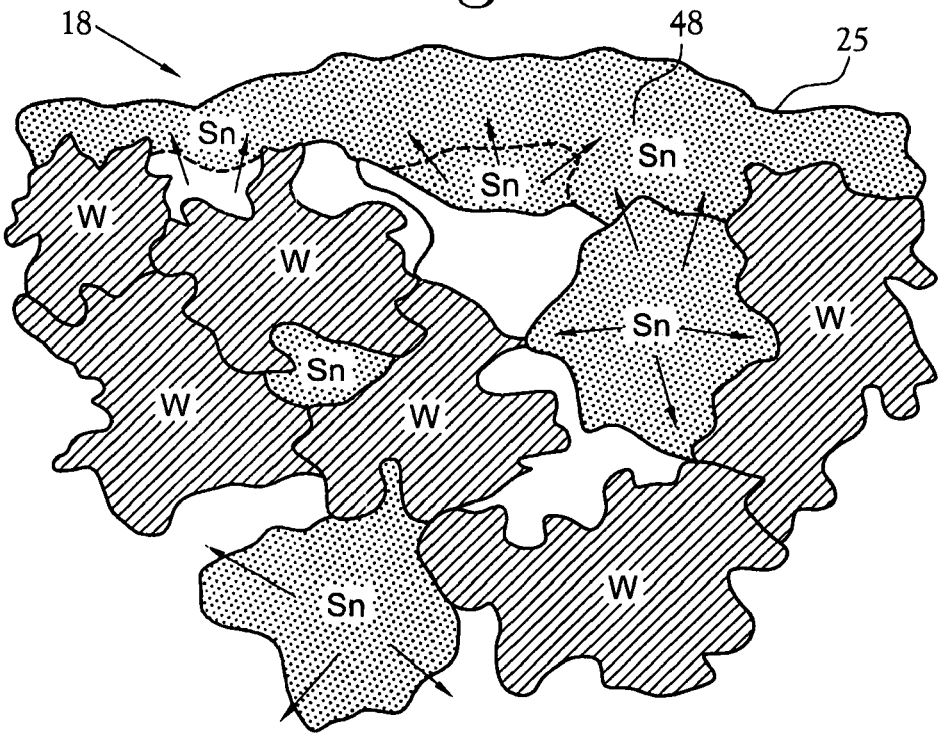
FIG. 14 is a schematic representation of the flow of molten tin powder particulates depicted in FIG. 10, upon the core being heated to at least the melting point of tin.
Figure 15:
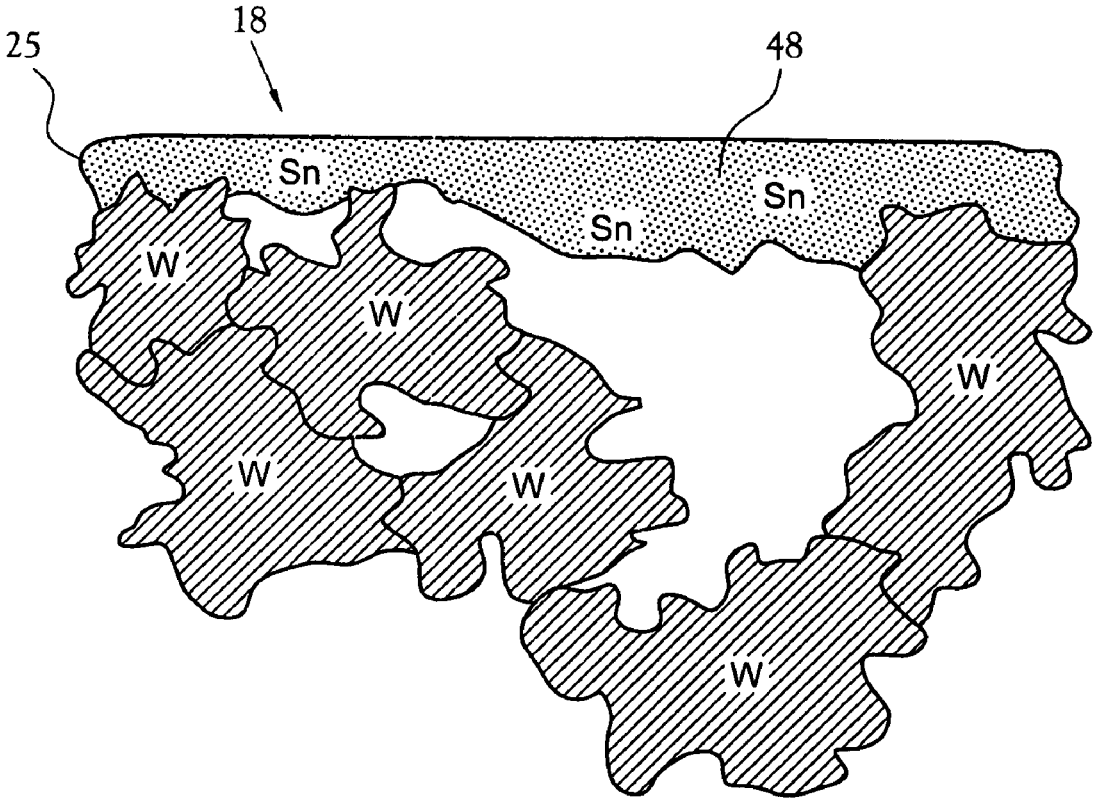
FIG. 15 is a schematic representation of the powder particulates of FIG. 14 after the molten tin has cooled and solidified and thereafter die pressed to flatten the domed metal into a cap of solid tin metal covering the top end of the core.

Particularly, it was noted that the solid metal cap of the core was integrally formed with the underlying tungsten particles adjacent the top end of the core as depicted a schematically in FIGS. 14 and 15. Thus, the covering remained bonded to the top end of the core both during formation of the ogive and during subsequent firing of the projectile from a weapon. This feature of the projectile is especially important in ensuring both non-movement of the cap and dislodgement of powder particles of the core, when a projectile formed from such core is fired from a weapon having a rifled barrel. Such stability of the covering was quite unexpected in view of the very large rotational rates (up to 300,000 rpm or more) of a projectile fired from a rifle, for example. Further, the deformed cap on the outboard end of the core, which was anchored within the jacket in the course of the forming of the ogive, served to retain the core against movement of the core within (and relative to) the jacket. This function of the cap further enhanced the unity of the jacket and core, hence enhancement of the accuracy of flight of the projectile from a weapon to a target and of the terminal ballistics of the projectile when it was fired into a target.

Figure 7:
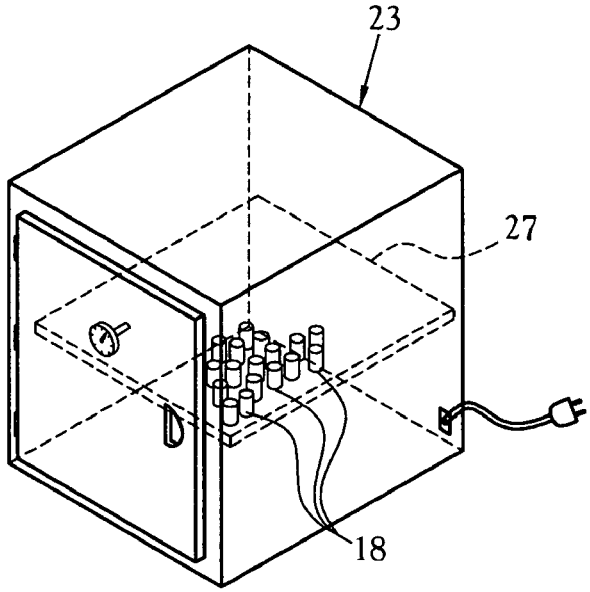
FIG. 7 depicts the heating of a plurality of cores (or jacket/core sub assemblies) in an oven.
Figure 9:
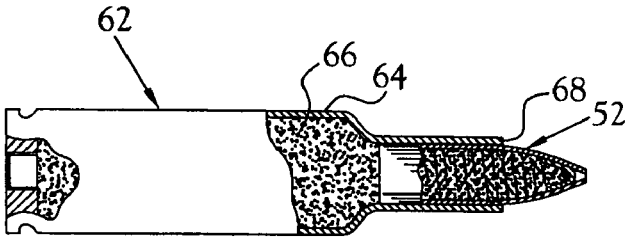
FIG. 9 depicts a round of ammunition which includes a projectile embodying a core in accordance with the present invention.

Manufacture of a round of ammunition 62 (FIG. 7) employing the projectile 52 of the present invention includes the well known steps of at least partly filling a case 64 with gun powder 66 and thereafter inserting the projectile 52 into the open end 68 of the case, as depicted in FIG. 9.

In the present invention, the time required to reach the fluidization temperature of the lower melting point metal powder (e.g., tin) varies with the proportion of tin within the core, and on the operating parameters of the oven employed, but in the present example, about ten minutes was consumed in bringing the core to the fluidization point of the tin powder. Thereupon, the door of the oven was opened to room temperature, thereby cooling the core to solidify the tin within the core and to solidify the accumulated metal on the core.

Other metal powders, such as zinc, iron, aluminum, copper, magnesium, bismuth or mixtures of these or similar relatively light-weight metal powders, including alloys thereof, may be employed as the "lighter density" metal powder in the manufacture of the core of the present invention. "Higher density" metal powders useful in the present invention include, in addition to tungsten, tantalum, uranium and carbides of these materials or mixtures or alloys of the same.

Firings of multiple ones of the projectiles provided in accordance with the present invention were carried out employing standard military rifles. The accuracy of delivery of the projectiles to a target were consistently within acceptable values. For example, multiple projectiles of .223 caliber (5.56 mm) of seven ogive, all prepared in like manner, were fired from the same conventional law enforcement and military weapon, namely a M16M4 military rifle having a seven twist barrel. Firings were from weapons having barrel lengths of 10 inches, 14.5 inches and 20 inches. All the projectiles exhibited excellent spin stability and accuracies of about one minute of angle at 600 yards.

Whereas the present invention has been described herein at times employing specific materials, operational methods and/or parameters, it will be recognized by one skilled in the art that suitable variations may be employed without departing from the scope of the invention as defined in the claims appended hereto.

What is claimed is:

1. A powder-based core having an outboard end, for a gun ammunition projectile, comprising a compressed quantity of a first powdered metal having a first melting point and a first density, and a second powdered metal having a melting point lower than the melting point of said first powdered metal and a second density which is less than the density of said first powdered metal, at least a portion of said first metal powder adjacent said outboard end of said powder-base core defining void interstices, and a quantity of said second powdered metal in solid form having at least portions thereof physically disposed within said interstices defined by said first metal powder of said core which are located adjacent said outboard end of said core thereby integrally bonding said quantity of said at least portions of said second powdered metal with said first powdered metal disposed adjacent said outboard end of said core.

2. The core of claim 1 wherein said core includes a longitudinal centerline and said quantity of said second powdered metal in solid form is disposed substantially radially uniformly about said longitudinal centerline of said core.

3. The core of claim 1 wherein said first powdered metal is chosen from the group comprising tungsten, tantalum, uranium, and carbides, mixtures and alloys of these metals.

4. The core of claim 1 where said first powdered metal is tungsten.

5. The core of claim 1 wherein said second powdered metal is tin.

6. The core of claim 1 wherein said first and second powdered metals comprise tungsten and tin, respectively.

7. The core of claim 1 wherein a majority of each of said first and second powdered metals comprises powder particles exhibiting a particle size of not greater than about 325 mesh.

8. A projectile comprising a core according to claim 1.

* * * * *